US006638015B2

(12) United States Patent
Ozawa et al.

(10) Patent No.: US 6,638,015 B2
(45) Date of Patent: Oct. 28, 2003

(54) WATER PUMP APPARATUS

(75) Inventors: Yasuo Ozawa, Kariya (JP); Junya Yamamoto, Toyota (JP); Masaki Chujo, Chiryu (JP); Takao Ozeki, Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/104,001

(22) Filed: Mar. 25, 2002

(65) Prior Publication Data

US 2002/0136633 A1 Sep. 26, 2002

(30) Foreign Application Priority Data

Mar. 23, 2001 (JP) ..... 2001-084511

(51) Int. Cl.[7] ..... F04D 29/12

(52) U.S. Cl. ..... 415/168.2; 415/230; 415/231; 123/41.44; 417/364; 417/423.11

(58) Field of Search ..... 415/168.1, 168.2, 415/169.1, 174.2, 230, 231; 123/41.44; 417/362, 364, 423.11

(56) References Cited

U.S. PATENT DOCUMENTS 5,216,984 A * 6/1993 Shimano et al. ..... 123/41.44
6,062,812 A * 5/2000 Ozawa ..... 415/168.2

FOREIGN PATENT DOCUMENTS

| | | | | |
|---|---|---|---|---|
| DE | 39 31 938 A1 | | 9/1989 | |
| DE | 41 28 286 A1 | | 8/1991 | |
| DE | 43 18 158 A1 | | 6/1993 | |
| EP | 0 473 359 A1 | | 8/1991 | |
| JP | 6-23760 | | 9/1988 | |
| JP | 5-39718 A | * | 2/1993 | ..... 123/41.44 |

OTHER PUBLICATIONS

Official letter from the German Patent Office dated Jan. 16, 2003 in a corresponding German Patent application along with an English Translation.

* cited by examiner

*Primary Examiner*—Christopher Verdier

(57) ABSTRACT

A water pump apparatus includes a body adapted to a fixed mounting surface of an engine and having a bore, a rotational shaft rotatably supported on the body via a bearing, an impeller fixed to the shaft and located in a pump chamber for supplying forcibly water from a water inlet to a water outlet, a seal member for sealing between the pump chamber and the bore of the body and a collection chamber portion provided on at least one of the body or the engine so as to communicate with the bore between the bearing and the seal member via a drain passage and for collecting water leaked via the seal member, wherein the collection chamber portion is opened toward the mounting surface of the engine and an opening of the collection chamber portion is fluid-tight closed by fixing the body to the engine.

4 Claims, 5 Drawing Sheets

WATER PUMP APPARATUS

CROSS REFERENCE TO RELATED APPLICATIONS

This application is based on and claims priority under 35 U.S.C. §119 with respect to a Japanese Patent Application 2001-084511, filed on Mar. 23, 2001, the entire content of which is incorporated herein by reference.

FIELD OF THE INVENTION

The present invention relates to a water pump apparatus, and more particularly to a water pump apparatus which is used in a cooling system for vehicles.

BACKGROUND OF THE INVENTION

A conventional water pump apparatus of this kind is disclosed in, for example, Japanese examined utility model publication No. 6(1994)-23760. As shown in FIG. 7, this water pump apparatus includes a body (a housing) 4 which is fixed to an engine block 3 via a gasket 2 and which has a central bore 5 and a pump chamber 6. A rotational shaft 8 having one end to which a pulley 7 is fixed is rotatably supported in the central bore 5 via a bearing 9. The pulley 7 is connected with a crank pulley (not shown) via a belt (not shown) and is rotated by the rotational force of a crank shaft (not shown). An impeller 10 is fixed to the other end of the rotational shaft 8 so that the impeller 10 is rotatably disposed in the pump chamber 6. The engine block 3 to which the body 4 is fluid-tight fixed is provided with a concave portion 11 which has an outer shape corresponding the pump chamber 6. The pump chamber 6 ensures a necessary volume in cooperation with the concave portion 11.

A mechanical seal 12 is disposed between the rotational shaft 8 and the body 4 for ensuring a liquid-tightness between the central bore 5 and the pump chamber 6. A water inlet 13 which is coaxially located at the rotational shaft 8 is provided with the engine block 3 and is opened into the concave portion 11. A water outlet 14 which is located at outer side of the impeller 10 in the radial direction is provided with the engine block 3 and is opened into the concave portion 11. Thus, when the rotational shaft 8 and the impeller 10 are rotated by the pulley 7, the water is sucked from the water inlet 13 to the pump chamber 6 and is discharged from the pump chamber 6 to the water outlet 14 by a centrifugal force.

The water which is leaked from the pump chamber 6 into the central bore 5 via the mechanical seal 12 flows into a drain pocket, namely a collection chamber portion 15 formed on the body 4 via a drain passage 16. The collection chamber portion 15 is opened in the opposite direction with respect to the engine block 3 and the opening of the collection chamber portion 15 is closed by a cap 17 which, is fixed to the body 4. A drain port 19 which is located in the upper side of the collection chamber portion 15 and which communicates between the collection chamber portion 15 and the atmosphere is formed on the body 4. Thus, when the collection chamber portion 15 is filled with the water leaked via the mechanical seal 12, the water is discharged from the collection chamber portion 15 via the drain port 19. In FIG. 7, a numeral 18 is a vapor outlet.

In the above mentioned prior water pump, since it is necessary to fix the cap 17 to the body 4 in a fluid-tight manner by, for example, press fitting and so on, the number of parts is increased and the precise processing is required for forming the opening of the collection chamber portion 15 and the cap 17. As a result, an increase in manufacturing cost cannot be avoided.

SUMMARY OF INVENTION

It is, therefore, an object of the present invention to provide an improved water pump apparatus which overcomes the above drawback.

In order to achieve this objective, according to the present invention, an improved water pump apparatus is provided which includes a body adapted so as to fix to a mounting surface of an engine and having a bore, a rotational shaft rotatably supported on the body via a bearing, an impeller fixed to the shaft and located in a pump chamber for forcibly supplying water from a water inlet to a water outlet, a seal member for sealing between the pump chamber and the bore of the body, and a collection chamber portion provided on at least one of the body or the engine so as to communicate with the bore between the bearing and the seal member via a drain passage and for collecting water leaked via the seal member, wherein the collection chamber portion is opened toward the mounting surface of the engine and an opening of the collection chamber portion is fluid-tightly closed by fixing the body to the engine.

BRIEF DESCRIPTION OF THE DRAWINGS

Additional objects and advantages of the present invention will become more apparent from the following detailed description of preferred embodiments thereof when considered with reference to the attached drawings, in which.

DESCRIPTION OF THE PREFERRED EMBODIMENTS

A water pump apparatus constituted in accordance with preferred embodiments of the present invention will be described with reference to attached drawings.

Figure 1:
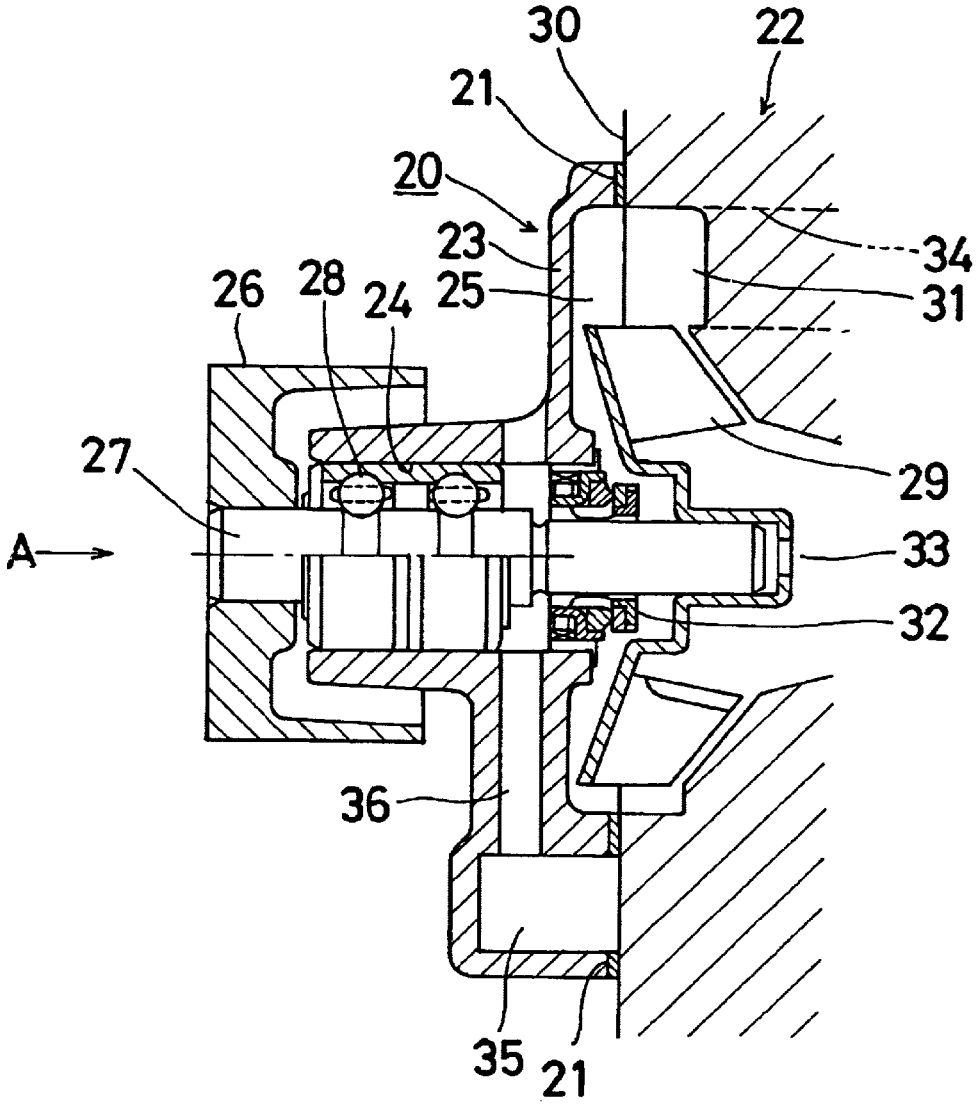
FIG. 1 is a cross-sectional view of a first embodiment of a water pump apparatus in accordance with the present invention.
Figure 2:
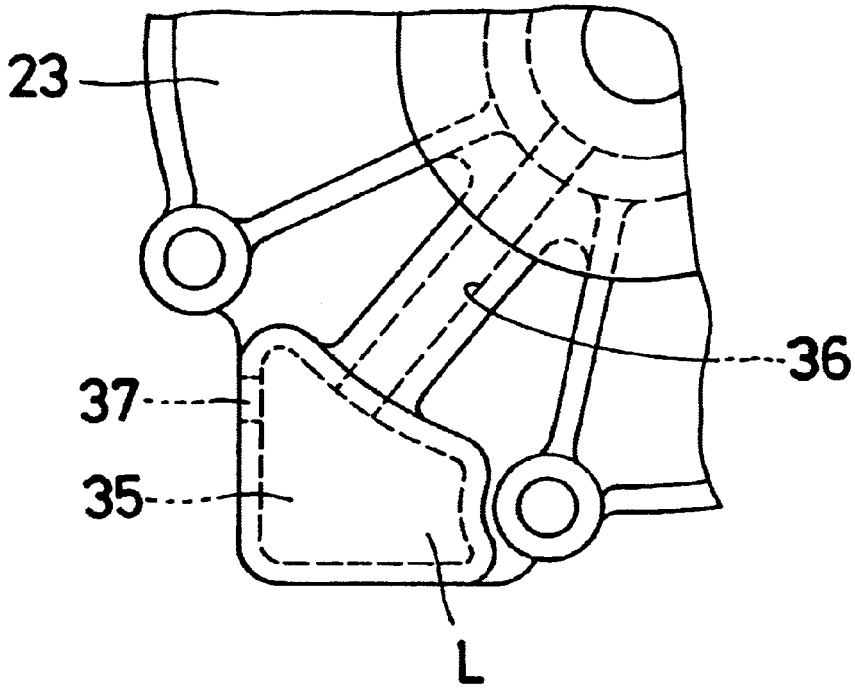
FIG. 2 is a partial front view of a body of the first embodiment viewing from an arrow A.
Figure 3:
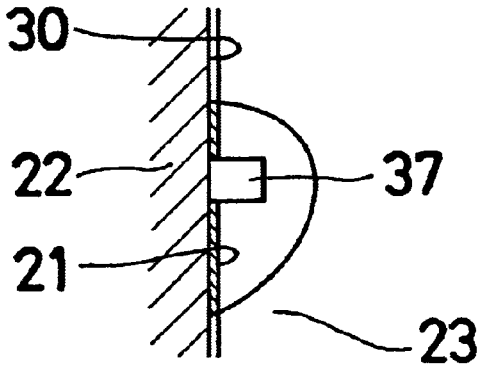
FIG. 3 is a side view showing a drain port of a first embodiment shown in FIG. 1.

FIGS. 1 to 3 show a first embodiment of the present invention. A water pump apparatus 20 includes a body (a housing) 23 which is fixed to an engine block 22 via a gasket 21 and which has a central bore 24 and a pump chamber 25 therein. A rotational shaft 27 having one end to which a pulley 26 is fixed is rotatably supported in the central bore 24 via a bearing 28. The pulley 26 is connected with a crank pulley (not shown) via a belt (not shown) and is rotated by the rotational force of a crank shaft (not shown). An impeller 29 is fixed to the other end of the rotational shaft 27 so that the impeller 29 is rotatably disposed in the pump chamber 25. The engine block 22 to which the body 23 is fluid-tightly fixed is provided with a concave portion 31 which is formed on a mounting surface 30 of the engine block 22 and which has an outer shape corresponding to the pump chamber 25. The pump chamber 25 ensures a necessary volume in cooperation with the concave portion 31.

A well-known mechanical seal 32 is disposed between the rotational shaft 27 and the body 23 for ensuring a liquid-tightness between the central bore 24 and the pump chamber 25. A water inlet 33 which is coaxially situated at the rotational shaft 27 is provided with the engine block 22 and is opened into the concave portion 31. A water outlet 34 which is located at the outer side of the impeller 29 in the radial direction is provided with the engine block 22 and is opened into the concave portion 31. Therefore, when the rotational shaft 27 and the impeller 29 are rotated by the pulley 26, the water is sucked from the water inlet 33 into the pump chamber 25 and is discharged from the pump chamber 25 to the water outlet 34 by a centrifugal force.

The water which is leaked from the pump chamber 25 into the central bore 24 via the mechanical seal 32 flows into a drain pocket, namely a collection chamber portion 35 formed on the body 23 via a drain passage 36. The collection chamber portion 35 is located below the central bore 24 and is extended parallel to the central bore 24. One end of the drain passage formed on the body 23 is communicated to a space in the central bore 24 located between the bearing 28 and the mechanical seal 32 and the other end thereof is communicated to the collection chamber portion 35.

One end of the collection chamber portion 35 which is located at the opposite side with respect to the engine block 22 is closed by a bottom portion and the other end thereof is opened toward the mounting surface 30 of the engine block 22. The opening of the other end of the collection chamber portion 35 is on the same plane with a mounting surface of the body 23 which is fixed to the mounting face 30 of the engine block 22 via the gasket 21. Therefore, when the body 23 is fixed to the mounting surface 30 of the engine block 22 via the gasket 21, the opening of the other end of the collection chamber 35 is fluid tightly closed and a fluid-tightly closed collection chamber is formed by the collecting chamber portion 35 and the engine block 22.

As shown in FIG. 2, the drain passage 36 is extended downward from the space between the mechanical seal 32 and the bearing 28 and is opened into the collection chamber portion 35 so that the water leaked via the mechanical seal 32 is led to the collection chamber portion 35. In this embodiment, in a front view of the body 23, the collection chamber portion 35 has an approximately triangular shape. However, the shape and the volume of the collection chamber portion 35 are not limited.

A drain port 37 which is communicated between the upper portion of the collection chamber portion 35 and the atmosphere is formed on the body 23. The drain port 37 is formed on the opening of the other end of the collection chamber portion 35 as a groove which is opened toward the mounting surface 30 of the engine block 22. The drain port 37 becomes a port for communicating the above-mentioned closed collecting chamber to the atmosphere when the body 23 is fixed to the mounting surface 30 of the engine block 22 via the gasket 21. Thus, when the collection chamber portion 35 (the closed collection chamber) is filled with the water leaked via the mechanical seal 32, the water is discharged from the collection chamber portion 35 via the drain part 37 and the leaked water is prevented from filling the drain passage 36 and the space in the central bore 24 between the mechanical seal 32 and the bearing 28.

According to the first embodiment, the opening of the collection chamber portion 35 is closed by the mounting surface 30 of the engine block 22 without using a cap at the same time as the body 23 is fixed to the engine block 22. Therefore, it is able to reduce the number of the parts and the manufacturing cost can be decreased.

Figure 4:
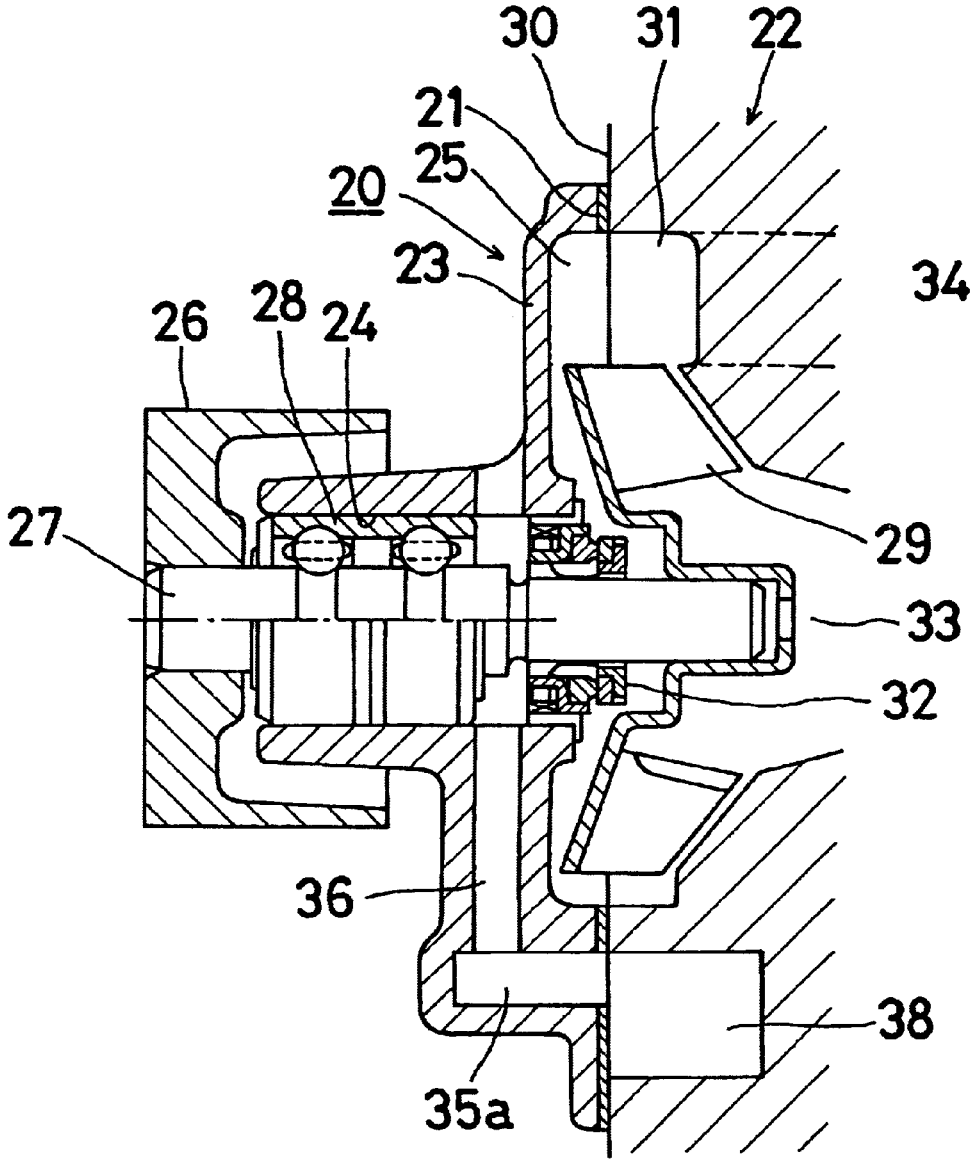
FIG. 4 is cross-sectional view of a second embodiment of a water pump apparatus in accordance with the present invention.
Figure 5:
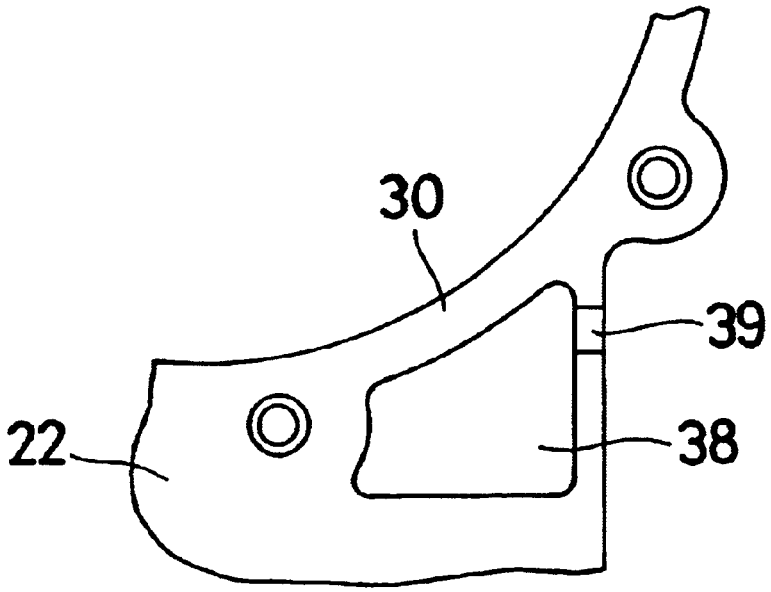
FIG. 5 is a partial front view of an engine block of a second embodiment shown in FIG. 4.
Figure 6:
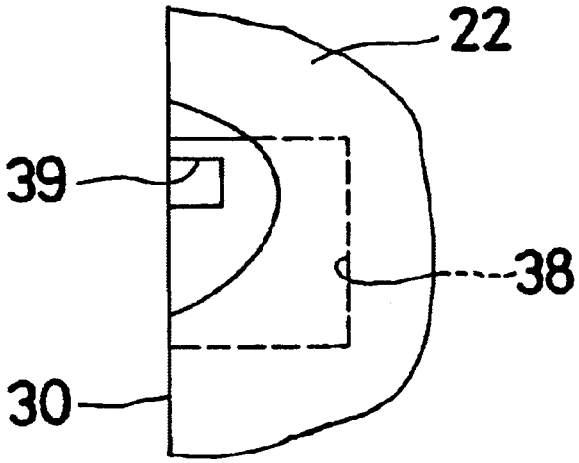
FIG. 6 is a side view showing a drain port of a second embodiment shown in FIG. 4.
Figure 7:
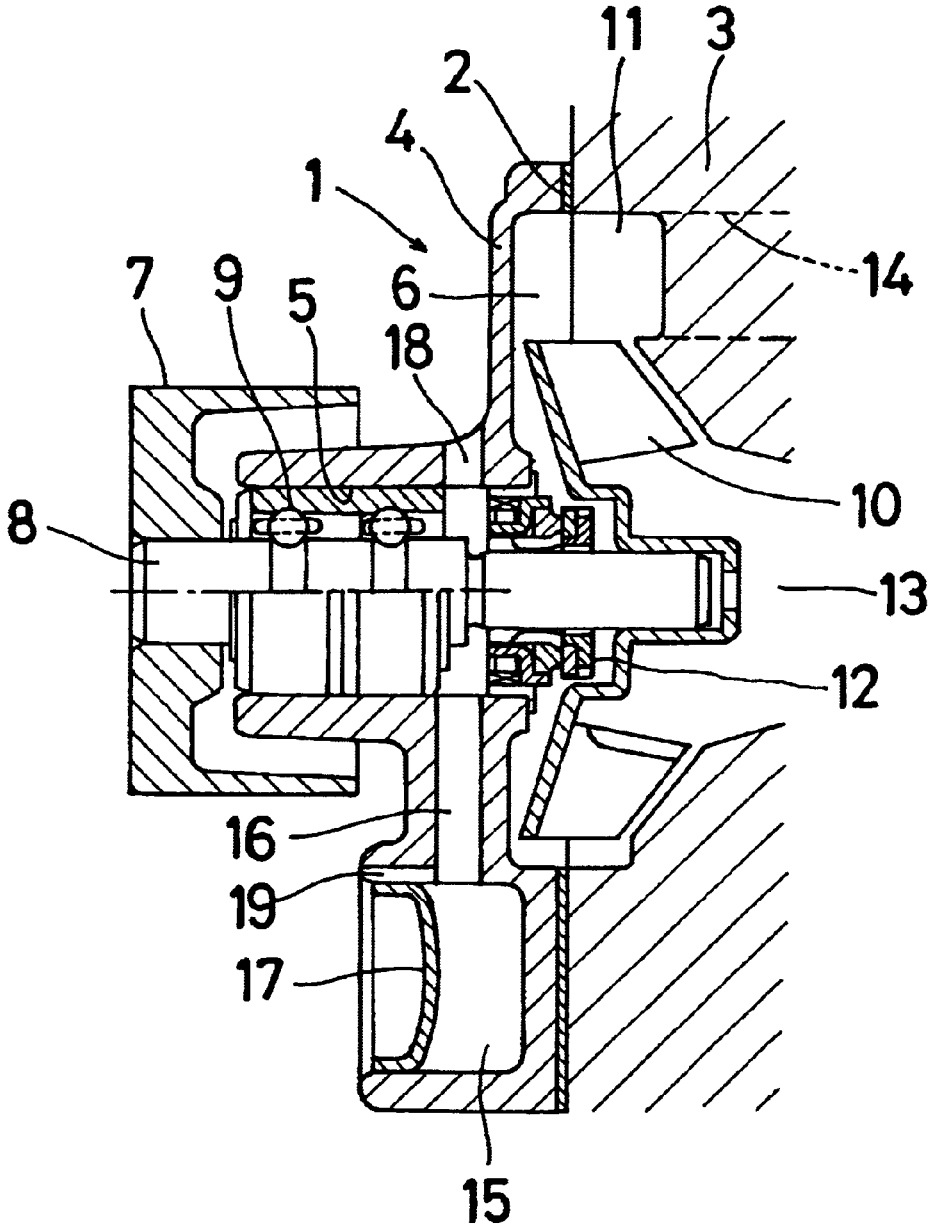
Fig. 7 Prior Art
FIG. 7 is a cross-sectional view of a prior water pump apparatus.

FIGS. 4 to 6 show a second embodiment of the present invention. In FIGS. 4 to 6, the same parts as compared with FIGS. 1 to 3 are identified by the same reference numerals and the description thereof is omitted. In this second embodiment, a first collection chamber portion 35*a* is formed on the body 23 so as to be located below the central bore 24 and is extended parallel to the central bore 24. The other end of the drain passage 36 is communicated to the first collection chamber portion 35*a*. One end of the first collection chamber portion 35*a* which is located at the opposite side with respect to the engine block 22 is closed by a bottom portion and the other end thereof is opened toward the mounting surface 30 of the engine block 22. The opening of the other end of the first collection chamber portion 35*a* is on the same plane with a mounting surface of the body 23 which is fixed to the mounting face 30 of the engine block 22 via the gasket 21. The volume of the first collection chamber portion 35*a* is smaller than that of the collection chamber portion 35 in the first embodiment.

A second collection chamber portion 38 is formed on the mounting surface of the engine block 22 as a concave portion and is opposite to one end of the first collection chamber portion 35*a*. The second collection chamber portion 38 becomes a fluid-tightly closed collection chamber in cooperation with the first collection chamber portion 35*a* when the body 23 is fixed to the mounting surface 30 of the engine block 22 via the gasket 21. The first collection chamber portion 35 a functions also as a passage.

A drain port 39 which is communicated between the upper portion of the second collection chamber portion 38 and the atmosphere is formed on the engine block 23. The drain port 39 is formed on the mounting surface 30 as a groove which is opened toward the mounting surface of the body 23. The drain port 39 becomes a port for communicating the above-mentioned closed collecting chamber to the atmosphere when the body 23 is fixed to the mounting surface 30 of the engine block 22 via the gasket 21. Therefore, when the first and second collection chamber portions 35*a* and 38 (the closed collection chamber) are filled with the water leaked via the mechanical seal 32, the water is discharged from the first and second collection chamber portions 35*a* and 38 via the drain port 39. According to the second embodiment, the openings of the first and second collection chamber portion 35*a* and 38 are closed by fixing the body 23 to the mounting surface 30 of the engine block 22 without using a cap at the same time as the body 23 is fixed to the engine block 22.

According to the first and second embodiment, the leaked water is collected in the collection chamber portion 35, or the first and second collection chamber portions 35*a* and 38 and the outer wall surface of the body 23, or the engine block 22 is not dirtied by the leaked water. However, as mentioned above, when the collection chamber portion 35 or the first and second collection chamber portions 35*a* and 38 are filled with the leaked water, the water is discharged from the drain port 37 or 39. At this time, in order to avoid the dirt of the outer wall surface of the body 23 or the engine block 22 which is adjacent to the drain port 37 or 39, a dye-proofing process, water repellent process or decomposable process may be performed on the outer wall surface of the body 23 or the engine block 22.

Normally, the water for cooling the engine (the cooling water) includes organic matter for improving the cooling effect and is colored. Therefore, in the first and second embodiments, on the outer wall surface of the body 23 or the engine block 22 which is adjacent to the drain port 37 or 39, surface coating material such as wax or a catalyst for decomposing a solid adhered to the outer wall surface due to the discharged water is applied thereon. In FIG. 2, a mirror surface layer L which can easily remove the water may be formed on the outer wall surface of the body 23 or the engine block 22 which is adjacent to the drain port 37 or 39. For example, a coating material in which fluorine is combined can be used for the dye-proofing, and a glass coating material for water repellent can be used. Further, a titanium oxide photocatalyst can be used for decomposing a solid which is a main component of the cooling water.

The principles, preferred embodiments and modes of operation of the present invention have been described in the foregoing description. The invention which is intended to be protected herein should not, however, be construed as limited to the particular forms disclosed, as these are to be regarded as illustrative rather than restrictive. Variations and changes may be made be those skilled in the art without departing from the spirit of the present invention. Accordingly, the foregoing detailed description should be considered exemplary in nature and not limited to the scope and spirit of the invention as set forth in the appended claims.

What is claimed is:

1. A water pump apparatus, comprising:

a body adapted to fix to a mounting surface of an engine and having a bore;

a rotational shaft rotatably supported on the body via a bearing;

an impeller fixed to the shaft and located in a pump chamber for forcibly supplying water from a water inlet to a water outlet, a seal member for sealing between the pump chamber and the bore of the body; and a collection chamber portion provided on at least one of the body or the engine so as to communicate with the bore between the bearing and the seal member via a drain passage and for collecting water leaked via the seal member, wherein the collection chamber portion is opened toward the mounting surface of the engine, and an opening of the collection chamber portion is fluid-tightly closed by fixing the body to the engine, the collection chamber portion is communicated to the atmosphere via a drain port which is formed on the body or the engine, and the drain port is opened toward the mounting surface of the engine.

2. A water pump apparatus as recited in claim 1, wherein the drain port is opened toward the mounting surface of the engine without any portion of a gasket which is placed between the body and the mounting surface of the engine.

3. A water pump apparatus, comprising:

a body adapted to fix to a mounting surface of an engine and having a bore;

a rotational shaft rotatably supported on the body via a bearing;

an impeller fixed to the shaft and located in a pump chamber for forcibly supplying water from a water inlet to a water outlet, a seal member for sealing between the pump chamber and the bore of the body; and a collection chamber portion provided on at least one of the body or the engine so as to communicate with the bore between the bearing and the seal member via a drain passage and for collecting water leaked via the seal member, wherein the collection chamber portion is opened toward the mounting surface of the engine, and an opening of the collection chamber portion is fluid-tightly closed by fixing the body to the engine, the collection chamber portion is communicated to the atmosphere via a drain port which is formed on the body or the engine, and one of a dye-proofing process layer, a water repellent process layer or a decomposition process layer for decomposing a solid is formed on an outer wall surface of the body or the engine which is adjacent to the drain port.

4. A water pump apparatus as recited in claim 3, wherein the drain port is opened toward the mounting surface of the engine without any portion of a gasket which is placed between the body and the mounting surface of the engine.

* * * * *